US010081925B2

(12) United States Patent
Amirian et al.

(10) Patent No.: US 10,081,925 B2
(45) Date of Patent: Sep. 25, 2018

(54) METHOD FOR CONSTRUCTING BUILDING THROUGH GRAVITY AND WEIGHT OF THE BUILDING STRUCTURE

(71) Applicants: Edvard Amirian, Tehran (IR); Vahid Saadatmand, Tehran (IR); Fardin Kanani, Tehran (IR); Areg Azizians, Tehran (IR)

(72) Inventors: Edvard Amirian, Tehran (IR); Vahid Saadatmand, Tehran (IR); Fardin Kanani, Tehran (IR); Areg Azizians, Tehran (IR)

( * ) Notice: Subject to any disclaimer, the term of this patent is extended or adjusted under 35 U.S.C. 154(b) by 0 days.

(21) Appl. No.: 15/395,207

(22) Filed: Dec. 30, 2016

(65) Prior Publication Data

US 2017/0107713 A1 Apr. 20, 2017

(51) Int. Cl.

| | |
|---|---|
| ***E02D 7/24*** | (2006.01) |
| ***E04B 1/35*** | (2006.01) |
| ***E02F 1/00*** | (2006.01) |
| ***E02D 27/00*** | (2006.01) |
| ***E02D 35/00*** | (2006.01) |

(52) U.S. Cl.

CPC ..... *E02D 7/24* (2013.01); *E02D 27/00* (2013.01); *E02D 35/005* (2013.01); *E02F 1/00* (2013.01); *E04B 1/35* (2013.01)

(58) Field of Classification Search

CPC ..... E02D 7/24; E02D 7/00; E02D 2017/0069; E02D 23/08; E02D 35/00; E02D 35/005; E21B 7/18; E02F 3/90; E02F 3/905; E02F 3/925; E04B 1/35; E04G 21/00; E21D 1/00

See application file for complete search history.

(56) References Cited

U.S. PATENT DOCUMENTS

| | | | | |
|---|---|---|---|---|
| 4,797,031 | A * | 1/1989 | Hagimoto | E02D 23/08 405/133 |
| 5,016,717 | A * | 5/1991 | Simons | E02F 5/003 175/206 |
| 5,197,827 | A * | 3/1993 | Lee | E02D 23/08 405/133 |
| 6,202,370 | B1 * | 3/2001 | Miller | B28B 7/0008 52/169.14 |
| 6,606,836 | B2 * | 8/2003 | Miller | B28B 7/0008 405/129.55 |
| 7,921,573 | B1 * | 4/2011 | Mancini | E02D 23/08 33/302 |
| 7,967,531 | B2 * | 6/2011 | Collina | B66F 7/20 405/229 |
| 8,858,124 | B2 * | 10/2014 | Lamonte | E02F 3/8825 175/67 |

(Continued)

*Primary Examiner* — Andrew J Triggs

(74) *Attorney, Agent, or Firm* — Barry Choobin; Patent 360

(57) ABSTRACT

A method for constructing a building structure using gravity and weight of the building structure is provided. The method includes designing an architecture and a construction plan of the building structure, planning an initial box for a structural design, tuning a ground required for construction of the building structure, constructing the initial box as per the planning, constructing an upper floor on the initial box, constructing remaining parts of the building structure including foundation for the building structure, and assembling a plurality of temporary structures to the building structure.

8 Claims, 8 Drawing Sheets

(56) References Cited

U.S. PATENT DOCUMENTS

| | | | | |
|---|---|---|---|---|
| 8,926,227 | B2 * | 1/2015 | Zago | E02D 35/00 405/229 |
| 2005/0163575 | A1 * | 7/2005 | Dagher | E02D 5/02 405/274 |
| 2010/0054859 | A1 * | 3/2010 | He | E02D 5/14 405/36 |
| 2010/0232888 | A1 * | 9/2010 | Kreis | E02D 7/24 405/248 |
| 2011/0280670 | A1 * | 11/2011 | Irvine | E02D 7/18 405/274 |
| 2015/0233078 | A1 * | 8/2015 | Bouchard | E02D 19/00 405/111 |
| 2015/0322642 | A1 * | 11/2015 | Wu | E04H 7/04 405/8 |
| 2017/0107713 | A1 * | 4/2017 | Amirian | E04B 1/35 |

* cited by examiner

400

METHOD FOR CONSTRUCTING BUILDING THROUGH GRAVITY AND WEIGHT OF THE BUILDING STRUCTURE

BACKGROUND

Technical Field

The embodiments herein are generally related to the field of construction industry. The embodiments herein are particularly related to an excavation of the land during the construction of infrastructure. The embodiments herein are more particularly related to a system and a method for excavating land for constructing a building structure.

Description of the Related Art

In the context of civil engineering, the term excavation refers to a process of moving earth, rock or other materials with tools, equipment or explosives. The process of excavation generally includes earthwork, trenching, wall shafts, tunneling, and underground. Excavation has a number of important applications including exploration, environmental restoration, mining, and construction. Among these, construction is one of the most common applications for excavation. The excavation is done in construction site to create building foundations, reservoirs, and roads. Some of the processes used in excavation include trenching, digging and dredging, burrow pit construction, and site development operations. Each of these operations requires unique techniques, tools, and machinery to get the job done in a suitable, correct and appropriate manner. The processes used in the excavation operation depends on the structure that results from the construction process.

The conventional methods for constructing an infrastructure includes construction of foundation (including the construction of burrow pit) at first and then constructing the subsequent floors. However, this method is not efficient for all the types of infrastructure as the process includes pitfalls, soil drift, and other soil and construction management problems. Further, the conventional methods also pose problems of safety of the construction workers.

Hence, there is a need for a system and method for excavation during a construction of an infrastructure by improving the safety of the construction workers and causing minimal problems during the excavation of the soil. Further, there is a need for a system and method for excavation that eases the process of construction of burrow pits during the excavation. Still further, there is a need for a system and method for excavation that eases the process of excavation and constructs the infrastructure based on gravity and weight of the infrastructure.

The above-mentioned shortcomings, disadvantages, and problems are addressed herein and which will be understood by reading and studying the following specification.

OBJECTS OF THE EMBODIMENTS HEREIN

The primary object of the embodiments herein is to provide a method and system to construct a burrow pit and subsequently the infrastructure such as a building using the combination of the gravity of the earth and the weight of the building.

Another object of the embodiments herein is to enable the construction of the infrastructure without a need for constructing the foundation first.

Yet another object of the embodiments herein is to increase the safety of the construction workers during the excavation.

Yet another object of the embodiments herein is to decrease the construction costs and time in building an infrastructure.

Yet another object of the embodiments herein to decrease the amount of soil transferred from the construction site.

Yet another object of the embodiments herein is to maintain a visual/aesthetic beauty of the construction site during construction of the infrastructure.

Yet another object of the embodiments herein is to eliminate or minimize the damage caused to the earth during the excavation.

Yet another object of the embodiments herein is to construct the infrastructure in a relatively lesser time compared to conventional methods.

Yet another object of the embodiments herein is to preserve the aesthetics while constructing the infrastructure.

These and other objects and advantages of the embodiments herein will become readily apparent from the following detailed description taken in conjunction with the accompanying drawings.

SUMMARY

The various embodiments herein provide a method for constructing a building structure using gravity and weight of the building structure. The method includes designing an architecture and a construction plan of the building structure, planning an initial box for a structural design, tuning a ground required for construction of the building structure, constructing the initial box as per the planning, constructing an upper floor on the initial box, constructing remaining parts of the building structure, and assembling the plurality of temporary structures to the building structure.

The architecture and construction plan is designed based on a plurality of constraints. The step of planning the initial box involves calculating a height of the initial box based on the designed architecture and the construction plan. Further, the step of tuning/turning the ground includes excavating soil from the ground according to the planned initial box.

According to an embodiment herein, the step of constructing the initial box involves building a plurality of retaining walls, main pillars, a plurality of beams, and a plurality of shear walls. The construction of the initial box is carried out using a plurality of construction machinery and materials which include concrete, a plurality of buckets, reinforced steel, iron, stones, bricks, and sand. Further, the construction of the upper floor includes construction of ceiling. The upper floor is constructed with an opening in the ceiling, and the upper floors are constructed using a plurality of temporary support structures.

According to an embodiment herein, the remaining parts include constructing walls, middle pillars, the opening of the ceiling and the initial box. The temporary structures are assembled to provide the required support to the building structure.

According to an embodiment herein, the plurality of constraints include the location of the building structure, weather condition or climatic at the location, a plurality of construction constraints, the ground condition of the building structure, and availability of machinery and materials.

According to an embodiment herein, the designing of the architecture and the construction plan are carried with the aid of a computing device. The computing device is selected from a group consisting of a laptop, a desktop, a mobile phone, a wearable device, a device having an ability to communicate with a network, a smart television, a virtual reality device, and an augmented reality device.

According to an embodiment herein, the step of designing the architecture and the construction plan includes planning an amount of soil to be excavated, an angle of the excavation, and the vertical length (depth) of the excavation. The tuning/turning of the ground is carried out using one or more excavators.

According to an embodiment herein, an opening is left or formed in the ceiling during the construction of the upper floor for transporting the required materials and machinery to and from the building structure.

According to an embodiment herein, the remaining parts of the building structure is constructed after allowing building structure to subside to the ground based on the gravity and the weight of the building structure.

According to an embodiment herein, a plurality of excavation nails are used while constructing the initial box, and wherein the plurality of excavation nails cut the soil symmetrically.

According to an embodiment herein, a plurality of lifts are used during the construction for transporting the materials and machinery through the ceiling opening.

According to an embodiment herein, the excavation operation is conducted using a plurality of excavators to enable symmetrical subsidence in all parts of the building and the excavation operation is stopped when the planned depth is reached.

The embodiments herein provide a method for constructing burrow pits and subsequently the infrastructure such as a building using a combination of gravity and the weight of the infrastructure. The method is used for projects which are relatively expensive and have a higher risk of an excavation operation, borrow pits consolidation and protection.

According to an embodiment herein, initially, basic parts of infrastructure such as a basement floor is constructed on the flat earth, without foundation. The basement floor is constructed in an acuminate (tapering) way. Further, a plurality of retaining walls of suitable height are constructed around the structure which protects the structure against soil pressure during and after excavation.

According to an embodiment herein, retaining walls are constructed at a suitable height around the structure to protect the structure against soil pressure during and after excavation operation. A temporary rafter is constructed in a ceiling of the basement's second floor to bear the weight of the upper floors. Further, a plurality of beams and pillars are constructed for supporting the structure, except a part of the ceiling from which the soil has to be removed.

The above-mentioned method of construction allows the structure to subside because of the weight of the structure itself. The weight of the structure essentially cuts the soil. The excavation is performed by excavators symmetrically and carefully to have symmetrical subsidence in all the parts and the building is designed and built to settle in a symmetrical line. The Excavation process is continued till the building reaches to the planned depth and stops there.

A part of the pillars, beams and ceiling are not operated in order to allow excavators to operate. By setting the building, the soil settled on the ground is removed by using a mechanical machinery such as an elevator/lift. Further, the excavator is also removed from the operating structure using the lift. Then the foundation is constructed and the walls and pillars are built through suitable connections which are predicted. Then the construction of the other pillars, beams and the ceiling of the basement are completed. The structure of the upper floors is constructed through common methods.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features, and advantages will occur to those skilled in the art from the following description of the preferred embodiment and the accompanying drawings in which.

Figure 1:
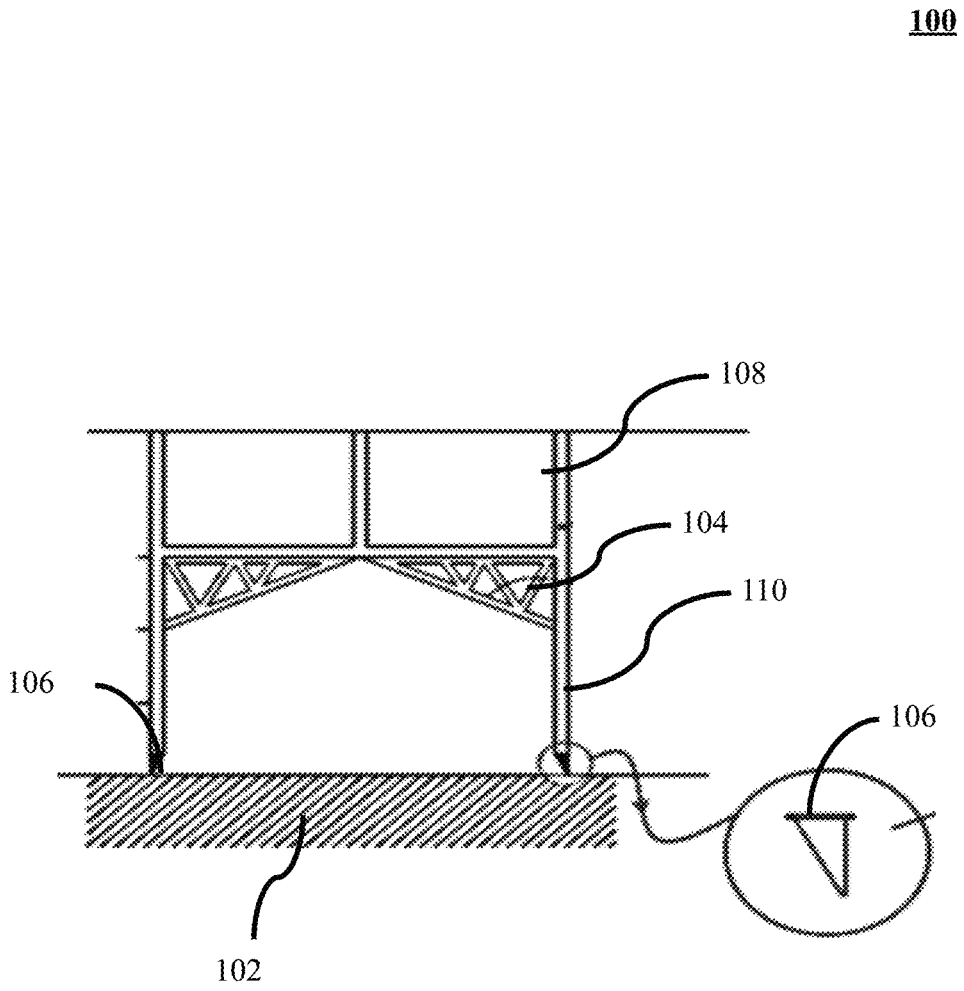
FIG. 1 illustrates a side view of a skeletal structure of a building structure constructed using gravity and its own weight, according to an embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE INVENTION

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a method for constructing a building structure using gravity and weight of the building structure. The method includes designing an architecture and a construction plan of the building structure, planning an initial box for a structural design, tuning a ground required for construction of the building structure, constructing the initial box as per the planning, constructing an upper floor on the initial box, constructing remaining parts of the building structure, and assembling the plurality of temporary structures to the building structure.

The architecture and construction plan is designed based on a plurality of constraints. The step of planning the initial box involves calculating a height of the initial box based on the designed architecture and the construction plan. Further, the step of tuning/turning the ground includes excavating soil from the ground according to the planned initial box.

According to an embodiment herein, the step of constructing the initial box involves building a plurality of retaining walls, main pillars, a plurality of beams, and a plurality of shear walls. The construction of the initial box is carried out using a plurality of construction machinery and materials which include concrete, a plurality of buckets, reinforced steel, iron, stones, bricks, and sand. Further, the construction of the upper floor includes construction of ceiling. The upper floor is constructed with an opening in the ceiling, and the upper floors are constructed using a plurality of temporary support structures.

According to an embodiment herein, the remaining parts include constructing walls, middle pillars, the opening of the ceiling and the initial box. The temporary structures are assembled to provide the required support to the building structure.

According to an embodiment herein, the plurality of constraints include the location of the building structure, weather condition or climatic at the location, a plurality of construction constraints, the ground condition of the building structure, and availability of machinery and materials.

According to an embodiment herein, the designing of the architecture and the construction plan are carried with the aid of a computing device. The computing device is selected from a group consisting of a laptop, a desktop, a mobile phone, a wearable device, a device having an ability to communicate with a network, a smart television, a virtual reality device, and an augmented reality device.

According to an embodiment herein, the step of designing the architecture and the construction plan includes planning an amount of soil to be excavated, an angle of the excavation, and the vertical length (depth) of the excavation. The tuning/turning of the ground is carried out using one or more excavators.

According to an embodiment herein, an opening is left or formed in the ceiling during the construction of the upper floor for transporting the required materials and machinery to and from the building structure.

According to an embodiment herein, the remaining parts of the building structure is constructed after allowing building structure to subside to the ground based on the gravity and the weight of the building structure.

According to an embodiment herein, a plurality of excavation nails are used while constructing the initial box, and wherein the plurality of excavation nails cut the soil symmetrically.

According to an embodiment herein, a plurality of lifts are used during the construction for transporting the materials and machinery through the ceiling opening.

According to an embodiment herein, the excavation operation is conducted using a plurality of excavators to enable symmetrical subsidence in all parts of the building and the excavation operation is stopped when the planned depth is reached.

The embodiments herein provide a method for constructing burrow pits and subsequently the infrastructure such as a building using a combination of gravity and the weight of the infrastructure. The method is used for projects which are relatively expensive and have a higher risk of an excavation operation, borrow pits consolidation and protection.

According to an embodiment herein, initially, basic parts of infrastructure such as a basement floor is constructed on the flat earth, without foundation. The basement floor is constructed in an acuminate (tapering) way. Further, a plurality of retaining walls of suitable height are constructed around the structure which protects the structure against soil pressure during and after excavation.

According to an embodiment herein, retaining walls are constructed at a suitable height around the structure to protect the structure against soil pressure during and after excavation operation. A temporary rafter is constructed in a ceiling of the basement's second floor to bear the weight of the upper floors. Further, a plurality of beams and pillars are constructed for supporting the structure, except a part of the ceiling from which the soil has to be removed.

The above-mentioned method of construction allows the structure to subside because of the weight of the structure itself. The weight of the structure essentially cuts the soil. The excavation is performed by excavators symmetrically and carefully to have symmetrical subsidence in all the parts and the building is designed and built to settle in a symmetrical line. The Excavation process is continued till the building reaches to the planned depth and stops there.

A part of the pillars, beams and ceiling are not operated in order to allow excavators to operate. By setting the building, the soil settled on the ground is removed by using a mechanical machinery such as an elevator/lift. Further, the excavator is also removed from the operating structure using the lift. Then the foundation is constructed and the walls and pillars are built through suitable connections which are predicted. Then the construction of the other pillars, beams and the ceiling of the basement are completed. The structure of the upper floors is constructed through common methods.

The various embodiments herein provide a method for constructing a building structure using the weight of the structure. At first, a building structure is designed as per the requirements and considering a plurality of parameters. The plurality of parameters includes, but are not limited to the location of the building, type of soil, budget of the building, building quality, the material used for constructing, law codes, standards, and geographical constraints. A building design is created using a computing device after considering the constraints. The examples of the computing device include a mobile phone, a laptop computer, a palmtop computer, a wearable device, a smart television, a projector, a virtual reality device, an augmented reality device. Further, a plurality of calculations on various estimates are also calculated. The calculations include measures to control the pressure and downfall of the adjacent soil, retaining walls are planned which are used as shear walls with a minor opening parts of the frame structure.

According to an embodiment herein, since the foundation is not constructed at first, a steel acuminated partition is constructed in the lower part of shear walls, pillars around for cutting soil and, further the foundation is designed and constructed which is calculated and designed for each project. The steel acuminated partition is constructed using a steel, reinforced concrete, or a combination thereof.

Further, the earth is flattened as per the requirements of the project and a suitable height of wall and pillar is chosen and the lower partition walls which are used around the pit and the frame of shear walls with the height of the building's beams are prepared and reinforcement is operated. Therefore, the lowest floor of the building's basement structure and the reinforced concrete walls are constructed. However, the ceiling and the central pillars are not constructed at this stage. Further, one of the openings is not operated in order to establish the excavation machine and other facilities, a post which the opening is blocked.

Further, shear walls and pillars of the floor on the basement is constructed on the earth. Once the shear walls and pillars are constructed, a plurality of beams of the basement's second floor is constructed. The temporary rafter that bears the weight of the upper floors are removed at a suitable time. According to the embodiment herein, the construction of the upper floors are done through the temporary rafter, which essentially means that except for some of the openings in the ceiling, all the beams and pillars can be constructed. A few of the pillars and beams are not operated for making space for excavators, and the said beams and pillars are constructed after the completion of the excavation activity.

FIG. 1 illustrates a diagram of a skeletal structure of a building structure constructed using gravity and its own weight, according to an embodiment herein. The skeletal structure includes one or more trestle 104, a plurality of excavation nails 106, a plurality of beams 110, and a main structure 108. The whole structure is supported on the flattened earth 102. The excavation nail 106 has a sharp end that allows cutting of the soil when there is sufficient weight from the top. The excavation nail 106 is constructed from a plurality of material including, but not limited to steel, reinforced steel, cement, a metallic structure, or a combination thereof. According to an embodiment herein, excavation nail 106 is placed below a plurality of beams 110 that support the weight of the construction carried by the main structure 108.

According to an embodiment herein, the excavation nail 106 is a placed below a plurality of retaining walls (not shown the figure) which are used as the support structure of the building. The trestle 104 is used for temporary support while constructing the building.

According to an embodiment herein, the trestle 104 is removed after the construction of the building and the foundation.

According to an embodiment herein, the trestles are not removed and are used as a support structure even after the completion of the construction of the building. The main structure 108 is constructed on the trestle 104 and is supported by the plurality of beams 110, retaining walls, etc., placed on the excavation nail 106. The trestle 104 are constructed from a material having the strength to hold the building weight. The material used for the construction of the trestle 104 include, but are not limited to steel, reinforced steel, iron, metals, alloys, cement, or a combination thereof.

Figure 2:
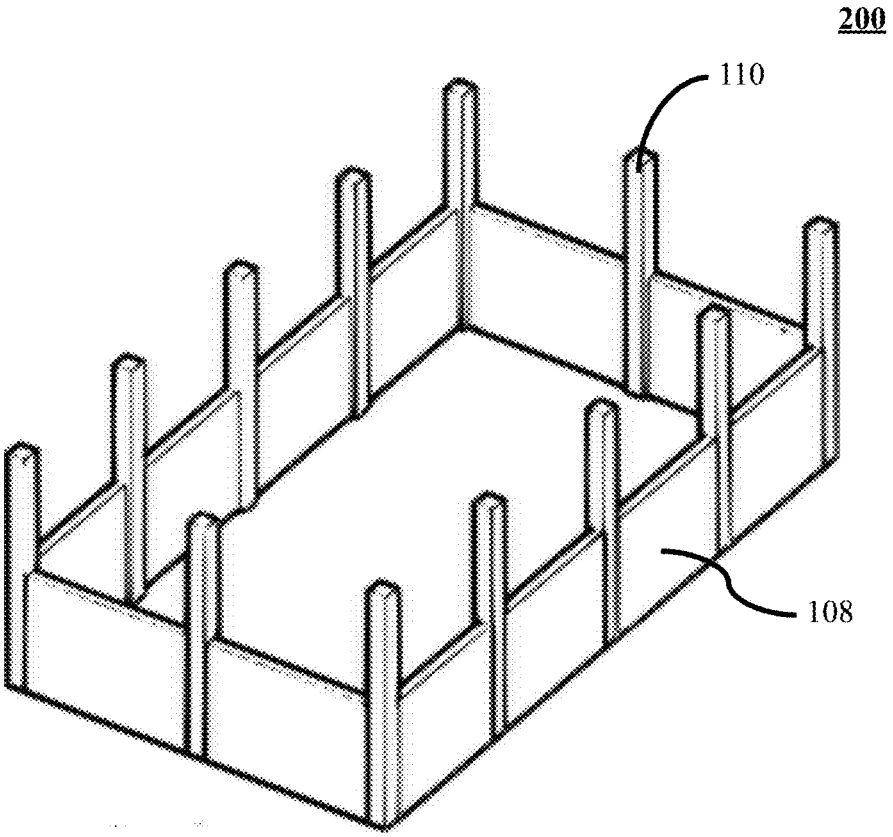
FIG. 2 illustrates a top side perspective view of a construction structure used for constructing a building, according to an embodiment herein.

FIG. 2 illustrates a semi-constructed structure used for constructing a building, according to an embodiment herein. The semi-constructed structure includes the main structure 108 which is constructed on the trestles and a plurality of beams 110 and optionally a plurality of retaining walls. According to an embodiment herein, the semi-constructed structure is built at the location of the building using the construction materials such as brick, concrete, iron, steel, and the like.

According to an embodiment herein, the semi-constructed structure is a pre-cast structure and is placed on the trestles and is bonded with the trestles for constructing the building.

Figure 3:
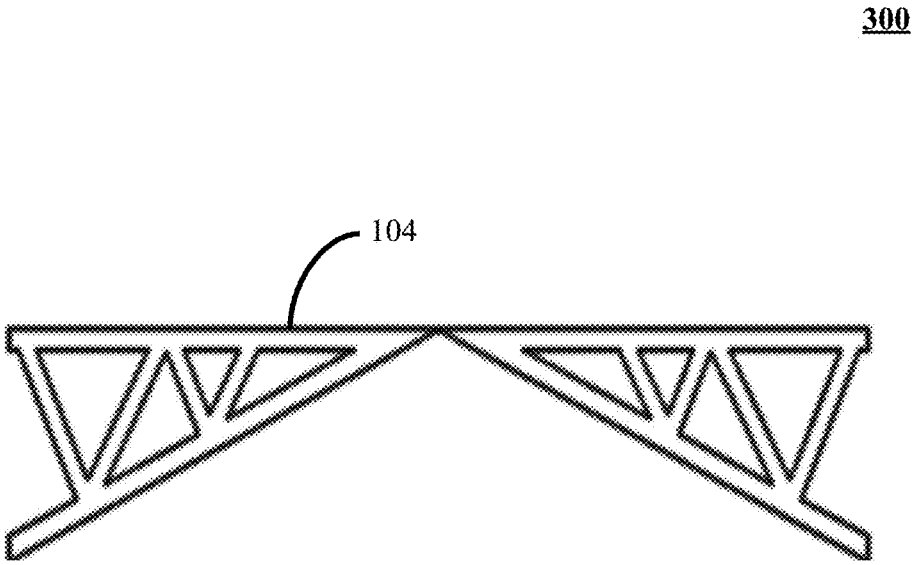
FIG. 3 illustrates a side view of trestle used for the construction of building using gravity, according to an embodiment herein.

FIG. 3 illustrates a trestle used for the construction of building using gravity, according to an embodiment herein. The trestle 104 is used for the construction of the upper floors of the building structure when the basement of the floor is not fully constructed, and the foundation is not yet laid, but the retaining walls are built. According to an embodiment herein, only single trestle 104 is used for the construction of the upper floors of the building.

According to an embodiment herein, a plurality of trestles placed in various directions are used for the construction of the upper floors of the building when the foundation is not yet constructed. The trestle 104 has varied structure and is constructed according to the needs of the building. With respect to FIG. 3, the trestle 104 has a framework which includes a horizontal beam supported by two pairs of sloping legs, and is used in pairs to support the weight of the building constructed on its top.

Figure 4:
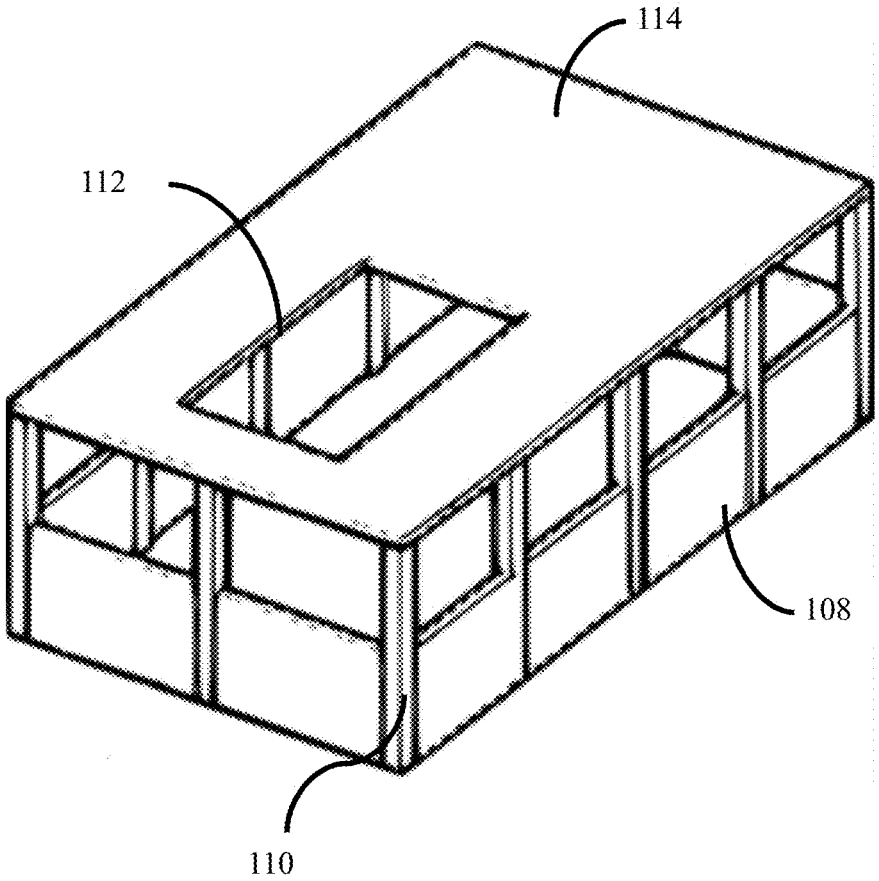
FIG. 4 illustrates a top side perspective view of semi-constructed building with an opening in the ceiling, according to an embodiment herein.

FIG. 4 illustrates a semi-constructed building with an opening in the ceiling, according to an embodiment herein. The semi-constructed building includes the main structure 108, the plurality of beams 110, a ceiling space 112, and a ceiling 114. FIG. 4 illustrates the construction of the upper floor of the semi-constructed building. According to an embodiment herein, the semi-constructed building 400 is constructed without first constructing the foundation. The ceiling space 112 is used for lifting the materials and the machinery from the flattened earth used for construction.

According to an embodiment herein, the ceiling space 112 is closed once the foundation is laid and the materials and machinery are lifted outside the construction site. Further, the ceiling 114 is constructed with the help of trestles using standard construction materials such as steel, iron, sand, cement, and the like.

Figure 5:
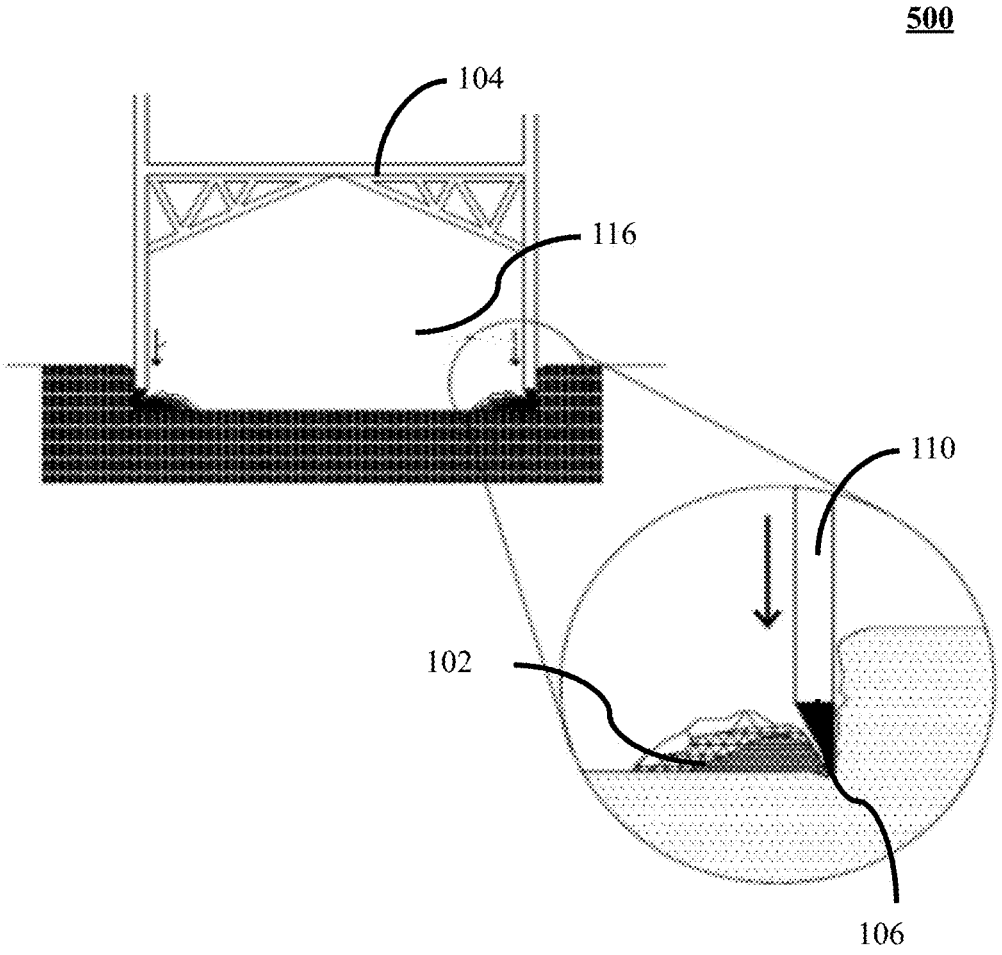
FIG. 5 illustrates a side view of the semi-constructed building indicating a magnified view of nail, according to an embodiment herein.

FIG. 5 illustrates a side view of the semi-constructed building, according to an embodiment herein. The semi-constructed building includes the plurality of beams 110, the trestle 104, the excavation nail 106, and a construction space 116. The beams 110 allows the semi-constructed building 500 to penetrate to the ground due to the gravity of the earth and the weight of the building. The penetration is supported by the beams 110 and the excavation nails 106 which are configured to cut/penetrate the soil/flattened earth 102 symmetrically. The construction space 116 is the empty space where the excavators operate and other required materials and machinery are placed.

Figure 6:
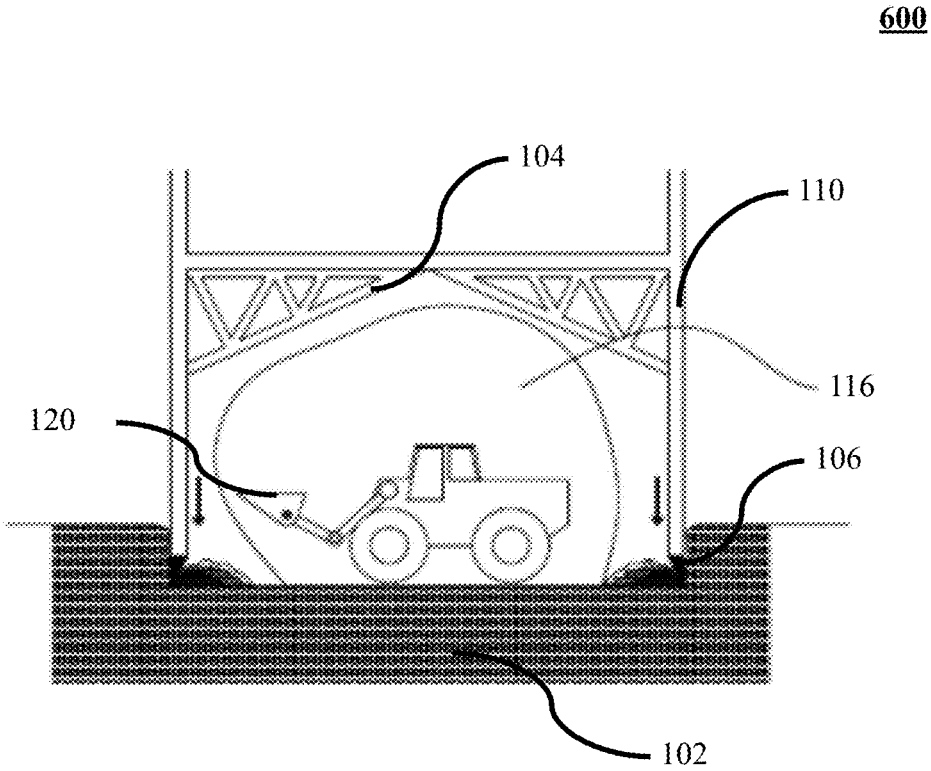
FIG. 6 illustrates a side view of the excavation for constructing a building structure, according to an embodiment herein.

FIG. 6 illustrates a side view of the excavation for constructing a building structure, according to an embodiment herein. The semi-structure of the building includes the trestle 104, the beam 110, the excavation space 116, the excavation nail 106, the flattened earth 102, and an excavator 120. The flattened earth is excavated using the excavator 120. According to an embodiment herein, a skilled worker is enabled to perform excavation operation by operating the excavator at the location.

According to an embodiment herein, the excavator is operated remotely by a person skilled in the art.

Figure 7:
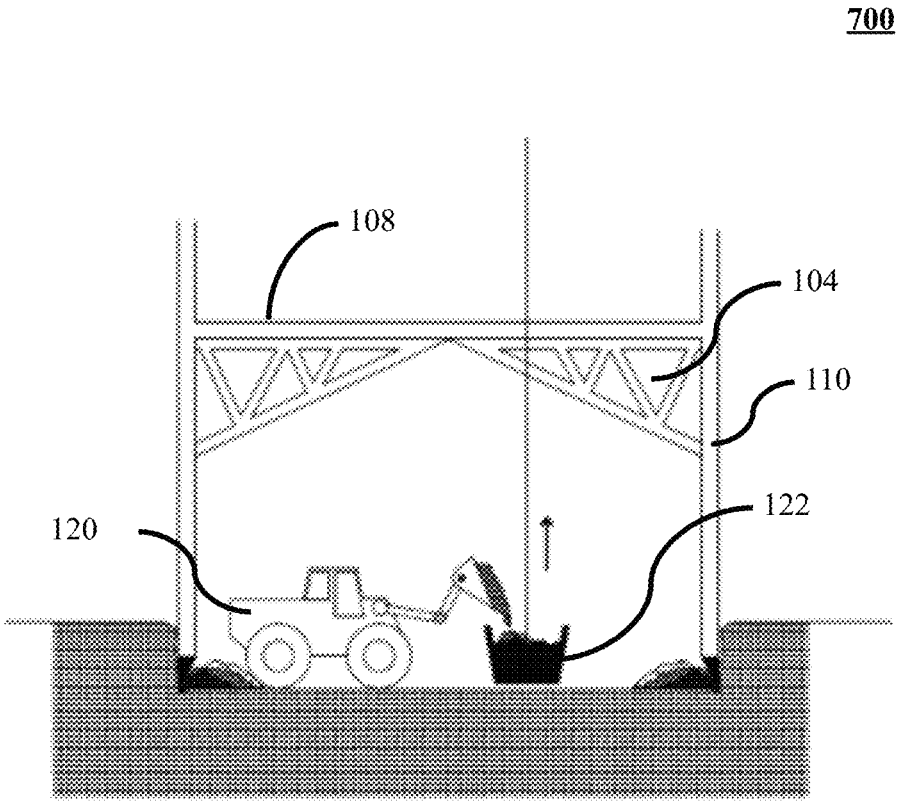
FIG. 7 illustrates a side view of the excavator during the excavation operation, according to an embodiment herein.

FIG. 7 illustrates a side view of the excavator during the excavation operation, according to an embodiment herein. The building structure during the excavation operation includes the excavation nail used for cutting/penetrating the soil symmetrically due to the weight of the main structure 108 constructed using trestle 104 and the beam 110. Further, the excavator 120 is configured to excavate the flattened soil and also the soil accumulated due to the penetration of the building to the ground. The building materials, rock materials is moved inside and outside the building structure using a lift 122. According to an embodiment herein, the lift 122 is a mechanical lift operated manually with the help of the workers on the construction site.

According to an embodiment herein, the lift 122 is an electro-mechanical elevator which is used for the purpose of the transferring the materials inside and outside of the building structure constructed.

Figure 8:
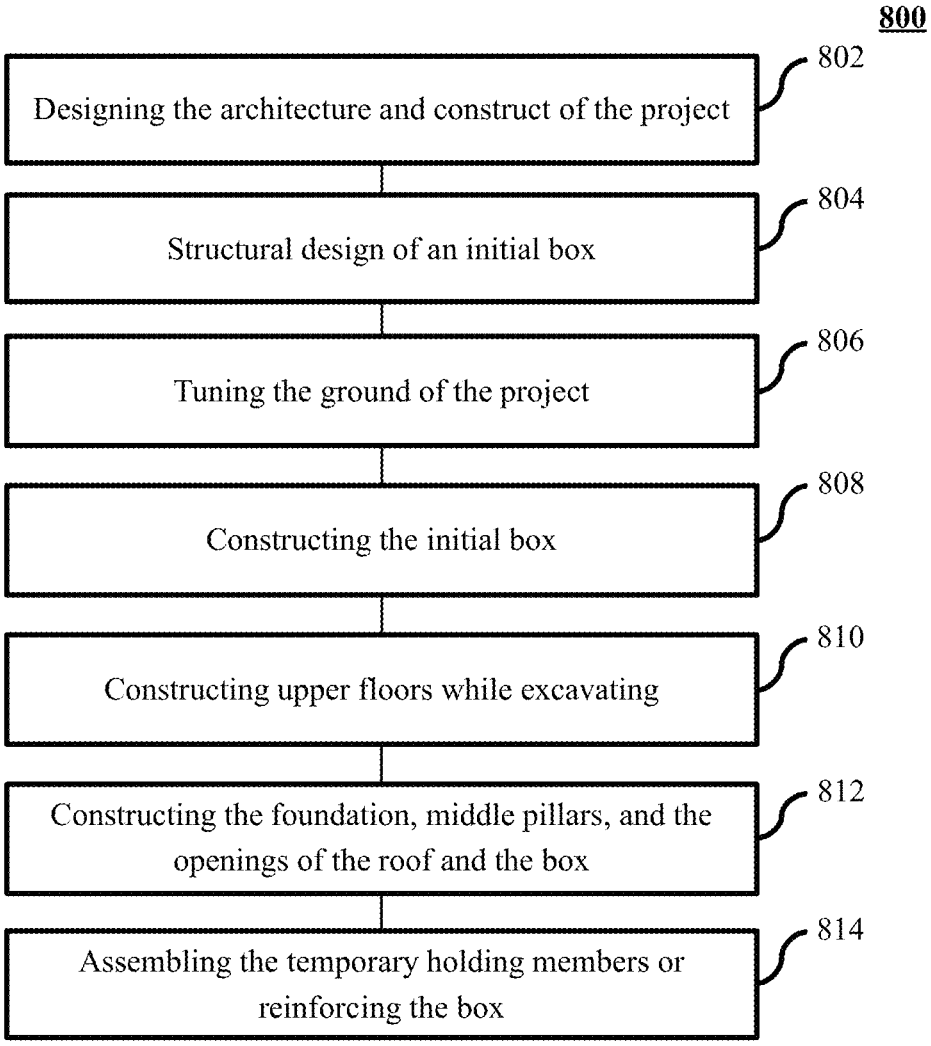
FIG. 8 illustrates a flowchart explaining a method for constructing a building structure using the gravity and excavation, according to an embodiment herein.

FIG. 8 illustrates a flowchart explaining a method for constructing a building structure using the gravity and excavation, according to an embodiment herein. At first, designing the architecture and construct of the project is undertaken (Step 802). The architecture and design of the project is carried out based on the plurality of parameters such as location, budget, design and architecture constraints, weather, and the like. According to an embodiment herein, a computing device is specially configured for specially designing architecture and construct of the project. According to an embodiment herein, a general computing device is used for designing the architecture and construct is used for this purpose. The examples of the computing device include a laptop, a desktop, a palmtop, a smart television, a wearable device, a virtual reality device, an augmented device, and the like. Further, the designing the architecture and the construct also includes planning the amount of excavation, the vertical length of the excavation, the angle of excavation, and the like.

Once the basic design of the architecture and the constructed box is completed, a structural design of an initial box is designed (Step 804). According to an embodiment herein, the initial box is a first structure which has to be implemented with a suitable height on a tuned soil to increase the safety and the output of excavators, by carrying and vacating the soil. The initial box is designed based on the dimension and the needs of the project. The initial box includes reinforcing members, holdings, and temporary rafters that after excavation the temporary parts are separated and the main box stays there and has the role of shear wall and a part of the main structure of the building.

Once the structural design of the project is completed, tuning of the ground for the building construction is initiated (Step 806). The tuning of the ground is done by an excavator. The tuning of the ground also requires a plurality of other machinery and materials such as excavation nails, sickle, bucket, and the like.

After the completion of the tuning/turning operation of the ground, the initial box as per the planning is constructed (Step 808). The construction of the initial box includes construction of retaining walls, beams and pillars, and the like. The construction of the initial box includes using construction machinery and materials such as excavators, elevator, steel, iron, reinforced concrete, and the like. However, the construction of the initial box does not include construction of the foundation.

Further, the construction of the upper floors are simultaneously carried out while excavating (Step 810). The main structure of the upper floors are constructed using one or more trestles and other supporting materials. According to an embodiment herein, a portion of the ceiling is left open to transfer the materials and machinery out of the construction site while constructing the main structure of the upper floors. According to an embodiment herein, the building is likely to subside to the gravity and the weight. The penetration of the building to the ground is supported by the excavation nails which cut the soil thoroughly.

After the main structure of the upper floors are constructed, and the building has subsided to the ground, the remaining parts of the building are constructed (Step 812). The remaining parts of the building include, but are not limited to foundation, middle pillars, the opening of the roof and the initial box. The construction of the main structure is completed using the standard materials such as reinforced concrete, steel, iron, sand, stones, and the like.

After the completion of the construction of the initial box and the main box, the temporary holding members are assembled in the building structure (Step 814). According to an embodiment herein, the temporary holding members such as trestles are reinforced in the initial box after the construction of the initial box and the main box. The reinforcing of the temporary holding members such as trestles hold the weight of the building and prevent the building from collapsing.

The embodiments herein provide a method for constructing a building using the gravity and its own weight. The method is designed to provide safety for the workers. Further, the embodiments herein decrease the cost of construction and the construction time, when compared to the conventional methods. Further, it requires less space for excavation and for transferring the soil. The embodiments herein also cause minimal damage to nature and also increases the visual beauty of the construction site.

The construction method disclosed in the embodiments herein is usable in various other construction architecture such as sewage, water pipes, city infrastructure, subway, underground parking facility, streets, highway and the like.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A method for constructing a building structure using gravity and weight of the building structure, the method comprising the steps of:

designing an architecture and a construction plan of the building structure, wherein the architecture and construction plan is designed based on a plurality of constraints;

planning an initial box for a structural design, and wherein the planning of the initial box includes calculating a height of the initial box based on the designed architecture and the construction plan;

tuning a ground required for construction of the building structure, and wherein tuning the ground includes excavating soil from the ground according to the planned initial box;

constructing the initial box as per the planning, and wherein constructing the initial box includes construction of a plurality of retaining walls, a plurality of main pillars, a plurality of beams, a plurality of shear walls, a plurality of trestles, and a plurality of excavation nails, and wherein the plurality of excavation nails are placed below the plurality of retaining walls, and wherein the plurality of excavation nails are configured to cut/penetrate a soil/flattened earth symmetrically due to a weight of a building structure, and wherein construction of the initial box is carried out using a plurality of construction machinery and materials including concrete, a plurality of buckets, reinforced steel, Iron, stones, bricks, and sand, and wherein an acuminated partition is constructed in a lower part of the plurality of shear walls, and wherein the acuminated partition is constructed using steel, reinforced concrete or a combination thereof;

constructing an upper floor on the initial box, wherein the construction of the upper floor includes construction of ceiling, and wherein the upper floor is constructed with an opening in the ceiling, and wherein the upper floor is constructed using a plurality of temporary support structures;

constructing remaining parts of the building structure, wherein the remaining parts include walls, middle pillars, an opening of the ceiling and the initial box;

assembling the plurality of temporary structures to the building structure, wherein the temporary structures are assembled to provide the required support to the building structure, and wherein the opening in the ceiling during the construction of the upper floor is left for transporting a plurality of required materials and machinery to and from the building structure, and wherein the plurality of trestles is used for a construction of upper floors, when the basement of the floor is not fully constructed, and wherein a structure of the plurality of trestles is varied based on a need of the building; and wherein the trestle has a framework which includes a horizontal beam supported by two pairs of sloping legs.

2. The method according to claim 1, wherein the plurality of constraints include a location of the building structure, weather of the location, a plurality of construction constraints, a ground condition of the building structure, and availability of machinery and materials.

3. The method according to claim 1, wherein the step of designing the architecture and the construction plan is carried with the aid of a computing device, and wherein the computing device is selected from a group consisting of a laptop, a desktop, a mobile phone, a wearable device, a device having an ability to communicate with a network, a smart television, a virtual reality device, and an augmented reality device.

4. The method according to claim 1, wherein the step of designing the architecture and the construction plan includes planning an amount of soil to be excavated, an angle of the excavation, and a vertical length (depth) of the excavation.

5. The method according to claim 1, wherein the tuning of the ground is carried out using one or more excavators.

6. The method according to claim 1, wherein the remaining parts of the building structure is constructed after allowing building structure to subside to the ground based on the gravity and the weight of the building structure.

7. The method to claim 1, wherein a plurality of lifts are used during the construction for transporting the materials and machinery through the ceiling opening.

8. The method according to claim 1, wherein an excavation operation is conducted using a plurality of excavators to enable symmetrical subsidence in all parts of the building, and is stopped when a planned depth is reached.

* * * * *